US009231316B2

(12) United States Patent
Hemmi et al.

(10) Patent No.: US 9,231,316 B2
(45) Date of Patent: Jan. 5, 2016

(54) ELECTRICAL TERMINAL ASSEMBLY HAVING AN INSERTION GROOVE

(71) Applicant: OMRON CORPORATION, Kyoto-shi (JP)

(72) Inventors: Yoshinobu Hemmi, Otsu (JP); Hirotada Teranishi, Osaka (JP)

(73) Assignee: OMRON CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 14/240,508

(22) PCT Filed: Oct. 12, 2012

(86) PCT No.: PCT/JP2012/076499

§ 371 (c)(1),
(2) Date: Feb. 24, 2014

(87) PCT Pub. No.: WO2013/054910

PCT Pub. Date: Apr. 18, 2013

(65) Prior Publication Data

US 2014/0213097 A1 Jul. 31, 2014

(30) Foreign Application Priority Data

Oct. 14, 2011 (JP) ..... 2011-227158

(51) Int. Cl.
*H01R 4/24* (2006.01)
*H01R 13/04* (2006.01)

(52) U.S. Cl.
CPC ..... *H01R 4/2425* (2013.01); *H01R 4/242* (2013.01); *H01R 13/04* (2013.01)

(58) Field of Classification Search
CPC ..... H01R 4/242; H01R 4/2425
USPC ..... 439/395, 400, 402, 404
See application file for complete search history.

(56) References Cited

U.S. PATENT DOCUMENTS

| | | | | | |
|---|---|---|---|---|---|
| 3,950,062 | A | * | 4/1976 | Reavis, Jr. | 439/408 |
| 4,230,391 | A | * | 10/1980 | Keglewitsch | 439/395 |
| 4,274,696 | A | * | 6/1981 | Long et al. | 439/395 |
| 4,317,608 | A | | 3/1982 | Dechelette | |
| 4,548,459 | A | * | 10/1985 | Mosser, III | 439/443 |
| 4,826,449 | A | | 5/1989 | Debortoli et al. | |
| 4,861,278 | A | * | 8/1989 | McBride et al. | 439/395 |
| 5,088,934 | A | * | 2/1992 | Chow et al. | 439/395 |
| 5,685,733 | A | * | 11/1997 | Janczak | 439/395 |
| 5,827,087 | A | * | 10/1998 | Yamasaki | 439/395 |

(Continued)

FOREIGN PATENT DOCUMENTS

| | | | |
|---|---|---|---|
| CA | 1229670 | A1 | 11/1987 |
| DE | 3541371 | A1 * | 5/1987 |

(Continued)

OTHER PUBLICATIONS

International Search Report for corresponding application PCT/JP2012/076499 filed Oct. 12, 2012; Mail date Jan. 8, 2013.

(Continued)

*Primary Examiner* — Tho D Ta
(74) *Attorney, Agent, or Firm* — Shinjyu Global IP

(57) ABSTRACT

A terminal, including an insertion groove to be pressed into by a conductor disposed between a pair of conductive arm parts, where a notched part larger than a width of the insertion groove is disposed at the end of the insertion groove.

5 Claims, 14 Drawing Sheets

(56) References Cited

U.S. PATENT DOCUMENTS

| | | | | |
|---|---|---|---|---|
| 6,093,047 | A * | 7/2000 | Ann | 439/398 |
| 6,368,128 | B1 | 4/2002 | Backer et al. | |
| 6,431,903 | B1 * | 8/2002 | Dittmann et al. | 439/395 |
| 6,478,604 | B1 * | 11/2002 | Downes et al. | 439/400 |
| 8,105,105 | B2 * | 1/2012 | Taniguchi et al. | 439/395 |
| 8,702,442 | B2 * | 4/2014 | Debenedictis et al. | 439/395 |
| 8,708,733 | B2 * | 4/2014 | Parrish | 439/395 |

FOREIGN PATENT DOCUMENTS

| | | | |
|---|---|---|---|
| DE | 8914739 | U1 | 2/1990 |
| DE | 9101351 | U1 | 4/1991 |
| DE | 102008011957 | A1 * | 9/2009 |
| FR | 2621423 | A1 * | 4/1989 |
| JP | S53-156080 | U | 12/1978 |
| JP | S56-007364 | A | 1/1981 |
| JP | H01-154471 | A | 6/1989 |
| JP | 4179072 | A | 6/1992 |
| JP | 7226236 | A | 8/1995 |
| JP | 09232010 | A | 9/1997 |
| JP | 9312106 | A | 12/1997 |
| JP | 2000-077109 | A | 3/2000 |
| JP | 5251115 | A | 3/2003 |
| JP | 200377552 | A | 3/2003 |
| JP | 3098197 | U | 9/2003 |
| JP | 2005209540 | A | 8/2005 |
| JP | 2011096628 | A | 5/2011 |

OTHER PUBLICATIONS

International Search Report for corresponding application PCT/JP2012/076497 filed Oct. 12, 2012; Mail date Jan. 8, 2013.

International Search Report for corresponding application PCT/JP2012/076498 filed Oct. 12, 2012; Mail date Jan. 15, 2013.

European Search Report from the corresponding European Patent Application No. 12839273.5 issued on May 4, 2015.

Office Action from the corresponding Japanese Patent Application No. 2013-538600 issued on Jun. 30, 2015.

* cited by examiner (A)

Prior Art
(B)

(A) Prior Art (B) Prior Art

ELECTRICAL TERMINAL ASSEMBLY HAVING AN INSERTION GROOVE

CROSS REFERENCE TO RELATED APPLICATION

This application is the U.S. National Phase of International Patent Application Number PCT/JP2012/076499 filed on Oct. 12, 2012 which claims priority to Japanese Patent Application No. 2011-227158 filed on Oct. 14, 2011, all of which said applications are herein incorporated by reference in their entirety.

TECHNICAL FIELD

The present invention relates to a terminal having an insertion part where an electrical wire or the like is pressed into a U-shaped insertion groove in, for example, relay connection of a censor or the like.

BACKGROUND ART

There have hitherto been provided a variety of terminals to be pressure-welded with an electrical wire, for use in a connector to connect the electrical wire.

Examples of such terminals include a terminal 103 in which an electrical wire 6 is pressed into an insertion part 102 provided with a U-shaped insertion groove 101 shown in FIG. 16(A). This terminal 103 was subjected to stress analysis of confirming a location of stress concentration and an amount of plastic deformation that occurs by a load by pressing the electrical wire 6 into the insertion part 102. It was found according to this stress analysis that stress concentrates on a region S.

Stress F1 concentrated on this region S specifically acts on each side of an end 104 of the insertion groove 101 which is curved in a U-shape, as shown in FIG. 17(A). The stress F1 can be decomposed into a horizontal component Fx and a vertical component Fy. Then, as shown in FIG. 17(B), this vertical component Fy is synthesized with a vertical component of stress F2 which is generated at the time of pressing an electrical wire 6 into the insertion groove 101, and stress is thus concentrated on an end 104.

FIG. 16(B) shows a result of the analysis of confirming the amount of plastic deformation, graphically representing a curve L indicative of the relation between the load applied to the insertion part 102 and the displacement amount thereby. Further, a straight line M in FIG. 16(B) is indicative of the relation between the applied load and the displacement amount with the insertion part 102 in an elastically deformed state. It is to be noted that the elastically deformed state refers to that the curve L is in a region of a straight line passing an origin, and this region is referred to as an elastic deformation region. The insertion part 102 of the terminal 103 is elastically deformed with the applied load up to a point P, but it is plastically deformed when the load further increases. For this reason, when the pressed-in electrical wire 6 is pulled out in a state where the applied load has reached a point Q, the insertion part 102 gets back along a straight line N parallel to the straight line M, to reach a point R. It was found from the above that this insertion part 102 is plastically deformed by pressing-in of the electrical wire 6.

As a terminal having the above configuration, a pressure-welding connector terminal, which is connected with an electrical wire via an insertion part provided with a U-shaped slit similarly to the above, is described in Japanese Unexamined Patent Publication No. H9-312106.

However, in the terminal described in this publication, the U-shaped slit is just provided in a platy insertion part and the insertion part is thus apt to be plastically deformed in the case of pressing an electrical wire into the U-shaped slit, thus leading to a decrease in force of holding the electrical wire. There has thus been a problem of poor repairability at the time of reinserting and using the electrical wire.

Further, when the strength of the insertion part is enhanced for ensuring predetermined force of holding the electrical wire, spring force of the insertion part needs increasing, thus causing a problem of making the U-shaped slit difficult for pressing-in of the electrical wire.

BRIEF SUMMARY

The present invention has been made in view of the above conventional problems, and provides a terminal which does not require a large amount of applied load at the time of pressing-in of an electrical wire and can avoid plastic deformation that occurs by the pressing-in of the electrical wire, thus ensuring the repairability at the time when the electrical wire is pulled out of an insertion groove and reinserted thereinto to be used.

The invention provides a terminal including an insertion groove to be pressed into by a conductor disposed between a pair of conductive arm parts, where a notched part larger than a width of the insertion groove is disposed at the end of the insertion groove.

BRIEF DESCRIPTION OF THE DRAWINGS

FIG. 2(A) is a front view before pressing of an electrical wire into an insertion part, FIG. 2(B) is a front view in a state where the electrical wire is pressed into an opening of the insertion part, and FIG. 2(C) is a front view in a state where the electrical wire is pressed into the insertion groove of the insertion part.

FIG. 7(A) is a perspective view of an insertion part where a triangular notched part is formed at the end of the insertion groove, FIG. 7(B) is a perspective view of an insertion part where an oblong hole-like notched part extending in a horizontal direction is formed at the end of the insertion groove, and FIG. 7(C) is a perspective view of an insertion part where an oblong hole-like notched part extending in a vertical direction is formed at the end of the insertion groove.

FIG. 8(A) is a perspective view showing a modified example where the conductive arm part is formed on a beam with uniform strength, FIG. 8(B) is a perspective view showing a modified example where a triangular through hole is provided in the conductive arm part, FIG. 8(C) is a perspective view showing a modified example where the inclined surface is provided on the conductive arm part of FIG. 8(B), and FIG. 8(D) is a perspective view showing a modified example where a long slit and a short slit are provided in the conductive arm part.

FIG. 10(A) is a perspective view showing a modified example where a circular slit is provided in the insertion part, FIG. 10(B) is a perspective view showing a modified example where an arc-like slit is provided in the insertion part, and FIG. 10(C) is a perspective view showing a modified example where a linear slit is provided in the insertion part.

FIG. 11(A) is a perspective view showing a modified example where a U-shaped slit is provided in the conductive arm part, and FIG. 11(B) is a perspective view showing a modified example where a linear slit is provided in the conductive arm part of FIG. 11(A).

FIG. 13(A) is a front view showing a modified example where a pressing-in notch is formed in a contact part, and FIG. 13(B) is a partially enlarged view of FIG. 13(A).

DETAILED DESCRIPTION

Figure 1:
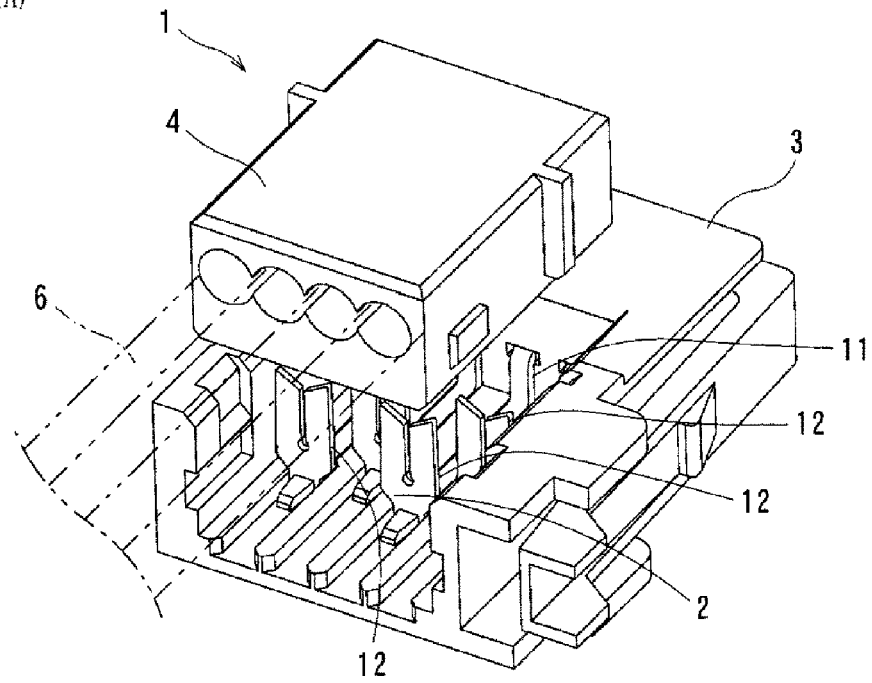
FIG. 1(A) is a perspective view showing a connector in a state where a housing mounted with a terminal according to First Embodiment of the present invention and a header with an electrical wire integrated therein are separated from each other.
FIG. 1(B) is a perspective view showing the connector in a state where the housing and the header of FIG. 1(A) are fitted with each other.
Figure 1:
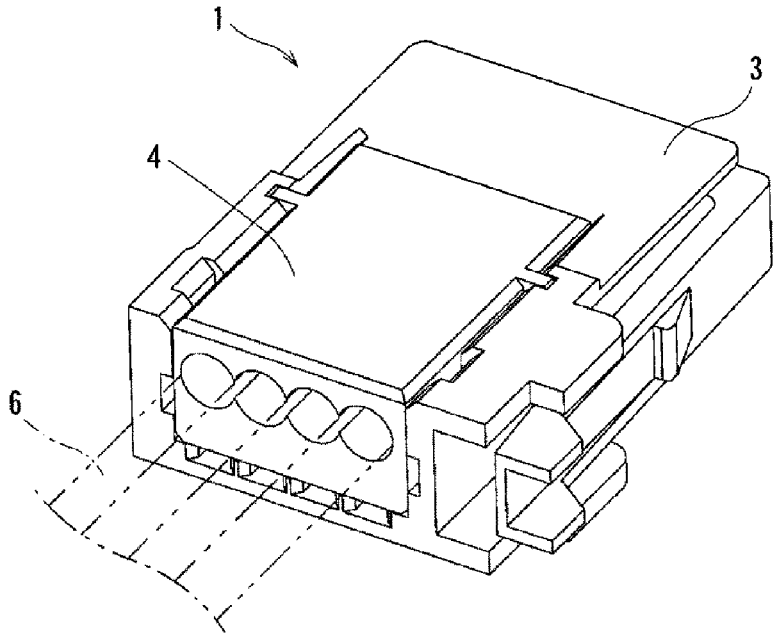
Figure 2:
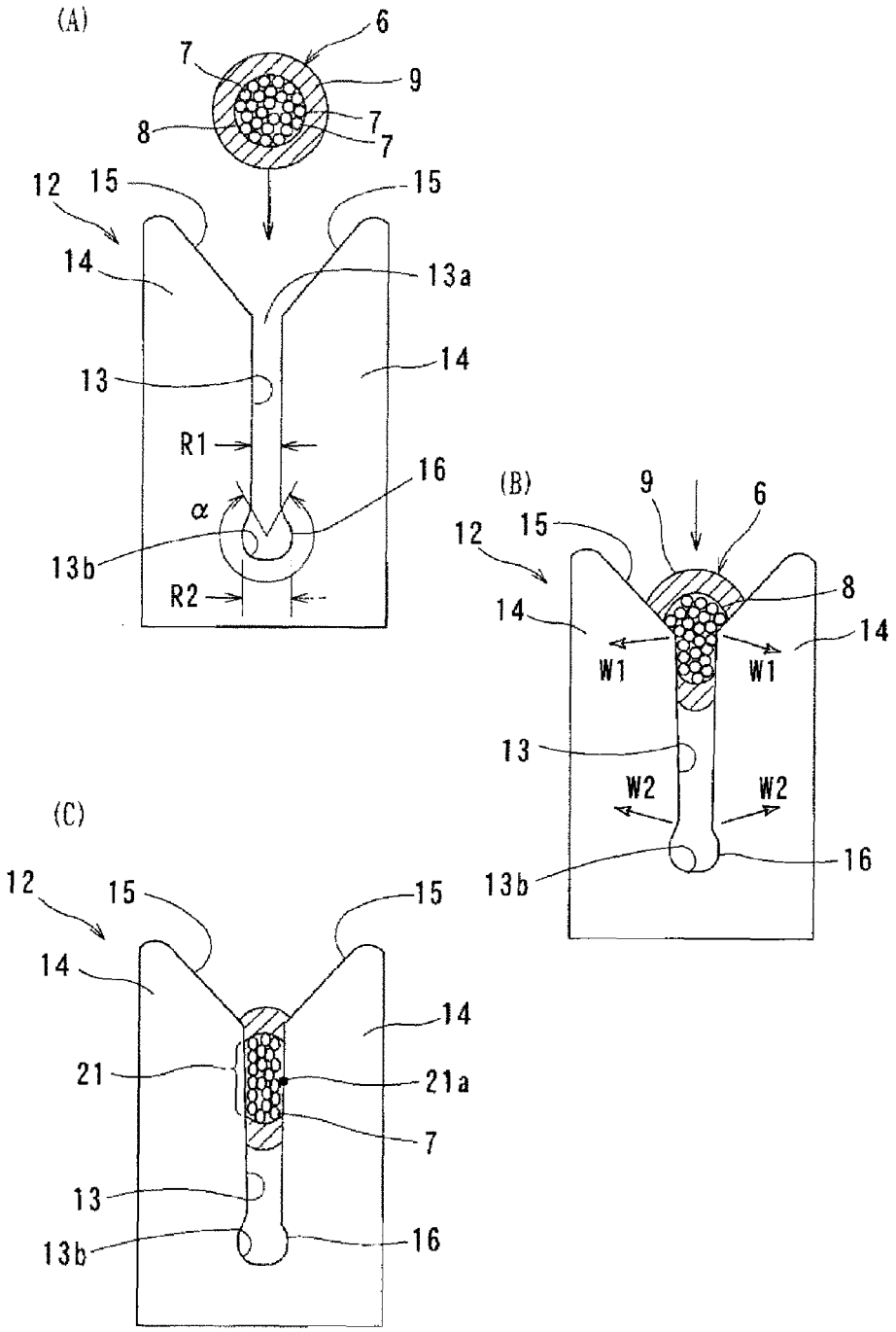
FIGS. 2(A) to 2(C) show a terminal according to First Embodiment.
Figure 3:
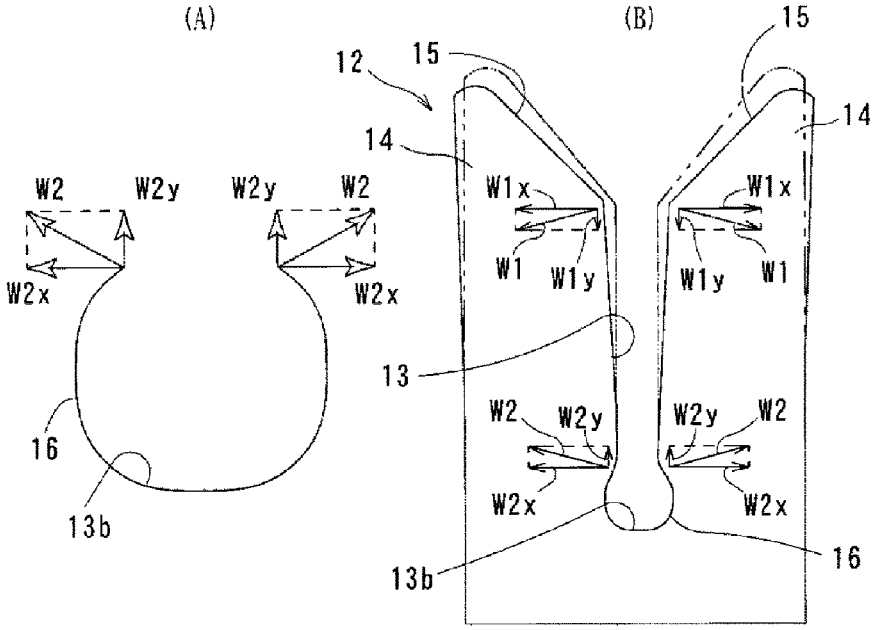
FIG. 3(A) is a partially enlarged view of a load applied to an arc-like notched part in FIG. 2(A)
FIG. 3(B) is a front view showing a detail of a load applied to the insertion part of FIG. 2(B).

Hereinafter, embodiments of a terminal 11 according to the present invention will be described in accordance with FIGS. 1 to 15.

In a First Embodiment, as shown in FIGS. 1(A) and 1(B), a connector 1 is made up of: a housing 3 which is mounted such that an insertion part 12 of the terminal 11 is located at an opening 2; and a header 4 with an electrical wire 6 integrated therein. Then, the header 4 is fitted into the opening 2 of the housing 3, to connect the insertion part 12 with the electrical wire 6.

Specifically, as shown in FIG. 2(A), the insertion part 12 of the terminal 11 is provided with: an insertion groove 13 which is pressed into by the electrical wire 6 from an opening 13*a* and holds it; a pair of conductive arm parts 14 which are symmetrically formed with this insertion groove 13 provided therebetween; and a peeling part 15 which removes a later-mentioned coated layer (coated material) 9 of the electrical wire (conductor) 6. An arc-like notched part 16 with an angle over 180° is provided at an end 13*b* of the insertion groove 13. A diameter R2 of this arc-like notched part 16 is larger than a width R1 of the insertion groove 13.

Next, an operation of pressing the electrical wire 6 into the insertion groove 13 will be described with reference to FIGS. 2(B) and 2(C).

The electrical wire 6 has a twisted line 8 bundling a plurality of single lines 7, and a coated layer 9 made up of a resin coating a periphery of this twisted line 8. Upon pressing-in of the electrical wire 6 from the upper portion of the insertion part 12, first, the coated layer 9 is removed by the peeling part 15 and the twisted line 8 is exposed.

When the electrical wire 6 is further pressed downward in the insertion groove 13, the twisted line 8 is guided downward while expanding the conductive arm part 14 obliquely downward by a load W1 (see FIG. 2(B)), and by reaction force thereof, the single line 7 begins to be deformed. Further, a load W2 is applied obliquely upward to each end of the arc-like notched part 16 of the insertion groove 13. This load W2 can be decomposed into a horizontal component W2*x* and a vertical component W2*y*, as shown in FIG. 3(A). Meanwhile, similarly, the load W1 can also be decomposed into a horizontal component W1*x* and a vertical component W1*y*, as shown in FIG. 3(B). The load W2*y* that is applied to the arc-like notched part 16 and the load W1*y* that is applied to the opening of the insertion groove 13 cancel each other, thereby to allow prevention of stress concentration at the end 13*b* of the insertion groove 13. Hence it is possible to reduce plastic deformation and plastic distortion that occur in the conductive arm part 14. For this reason, the holding force does not decrease at the time when the electrical wire is once pulled out of the insertion groove 13 and reinserted thereinto to be used, and the repairability can be ensured. Further, since it is just to provide the arc-like notched part 16, there is an advantage of simplifying the configuration of the conductive arm part 14 and allowing reduction in production cost of the terminal 11.

Then, the twisted line 8 pressed into the insertion groove 13 is pushed thereinto with the single lines 7 in the state of being undone from the bundle and densely provided within the insertion groove 13 (see FIG. 2(C)). At this time, the twisted line 8 expands the conductive arm part 14 outward from a center 21*a* of a contact part 21, while each of the single lines 7 is plastically deformed by reaction force from the conductive arm part 14 and comes into contact with the conductive arm part 14 to be electrically conducted therewith.

Figure 4:
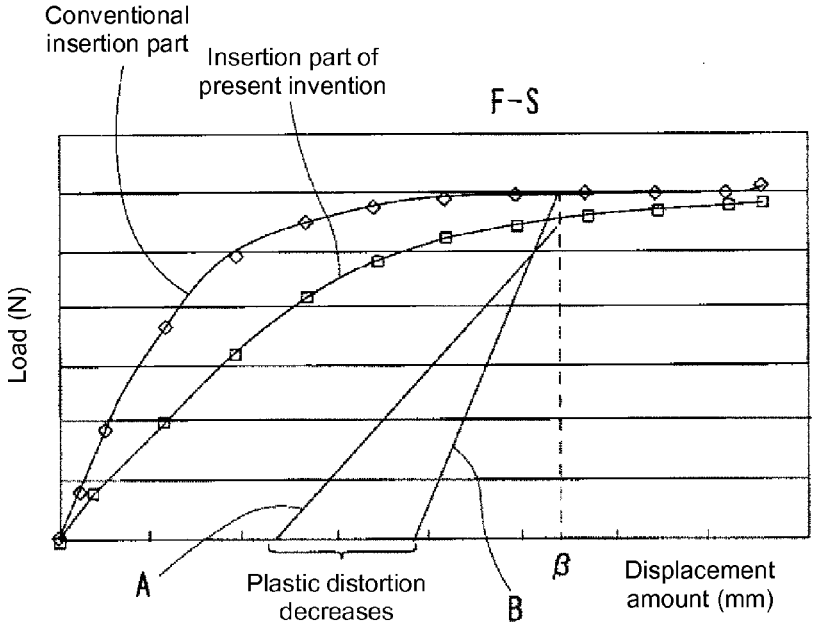
FIG. 4 is a graph showing the relation between each of loads, respectively applied to the insertion part of the present invention and a conventional insertion part, and a displacement amount thereby.
Figure 5:
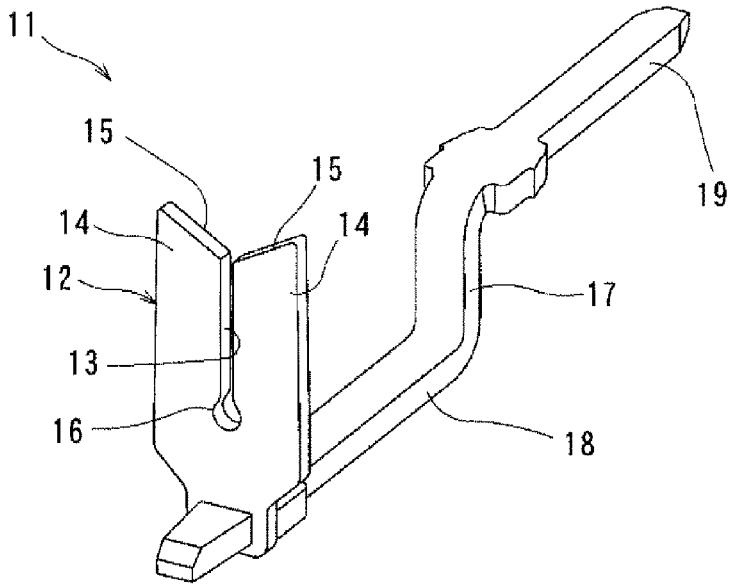
FIG. 5(A) is a perspective view of the terminal of FIG. 1.
FIG. 5(B) is a perspective view showing a modified example of the terminal of FIG. 5(A).
Figure 5:
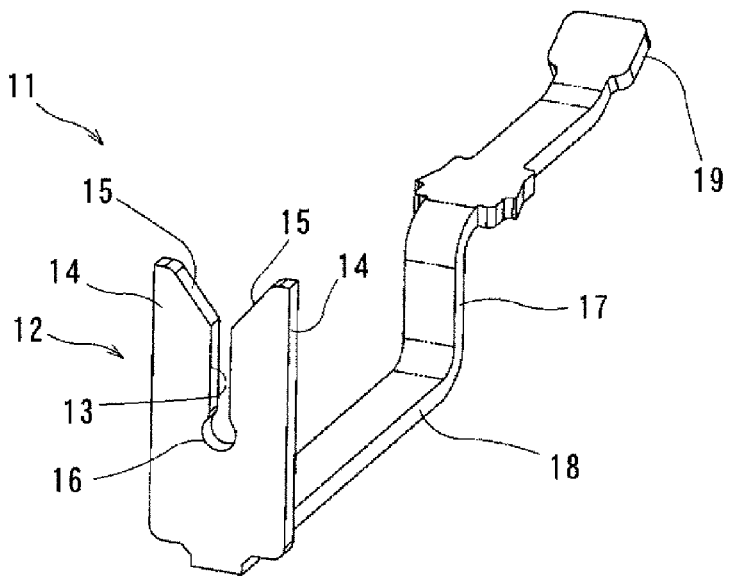
Figure 6:
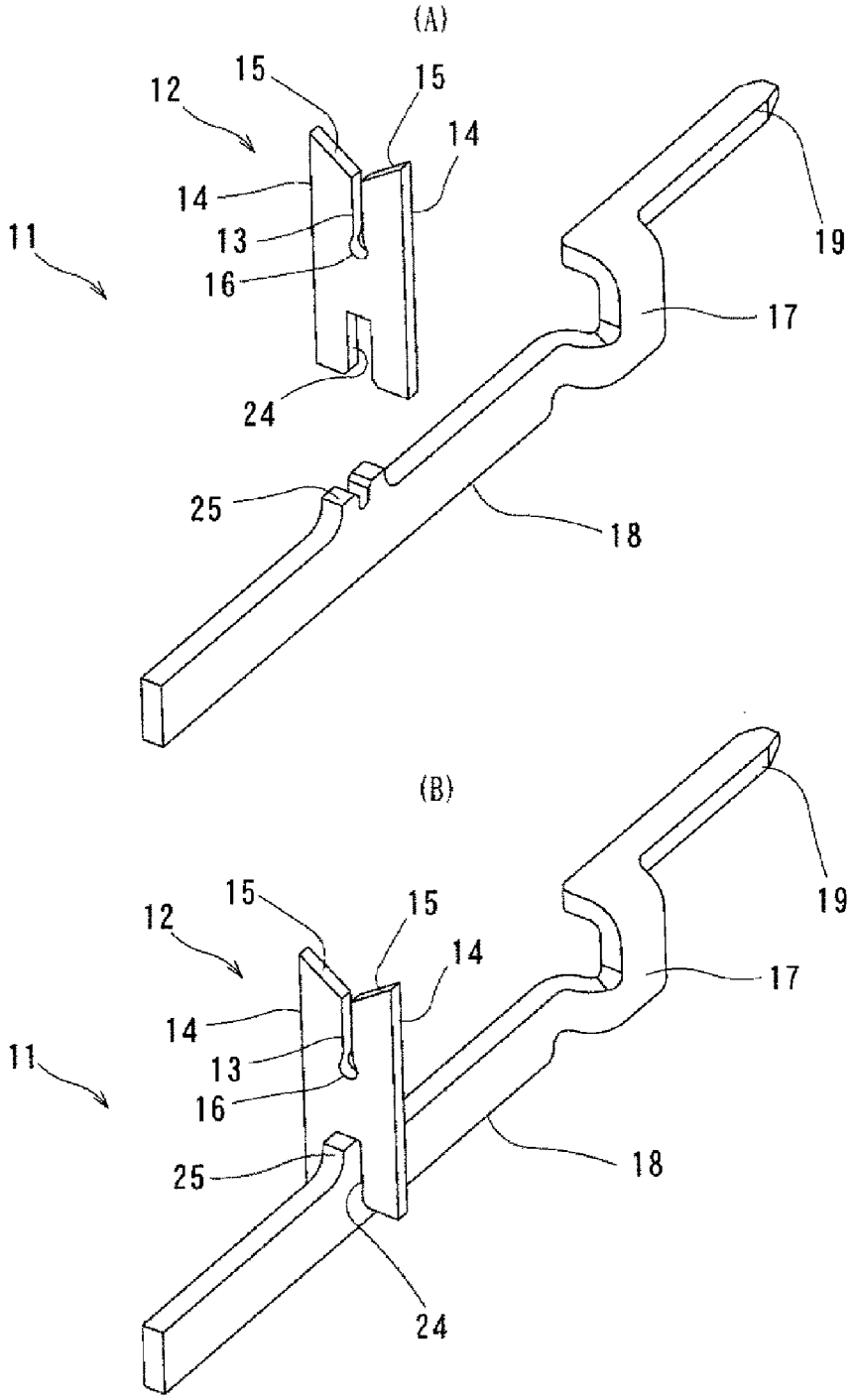
FIG. 6(A) is a perspective view showing a modified example of the terminal in a state where the insertion part is separated from a conductive part.
FIG. 6(B) is a perspective view showing a state where the insertion part is joined with the conductive part.
Figure 7:
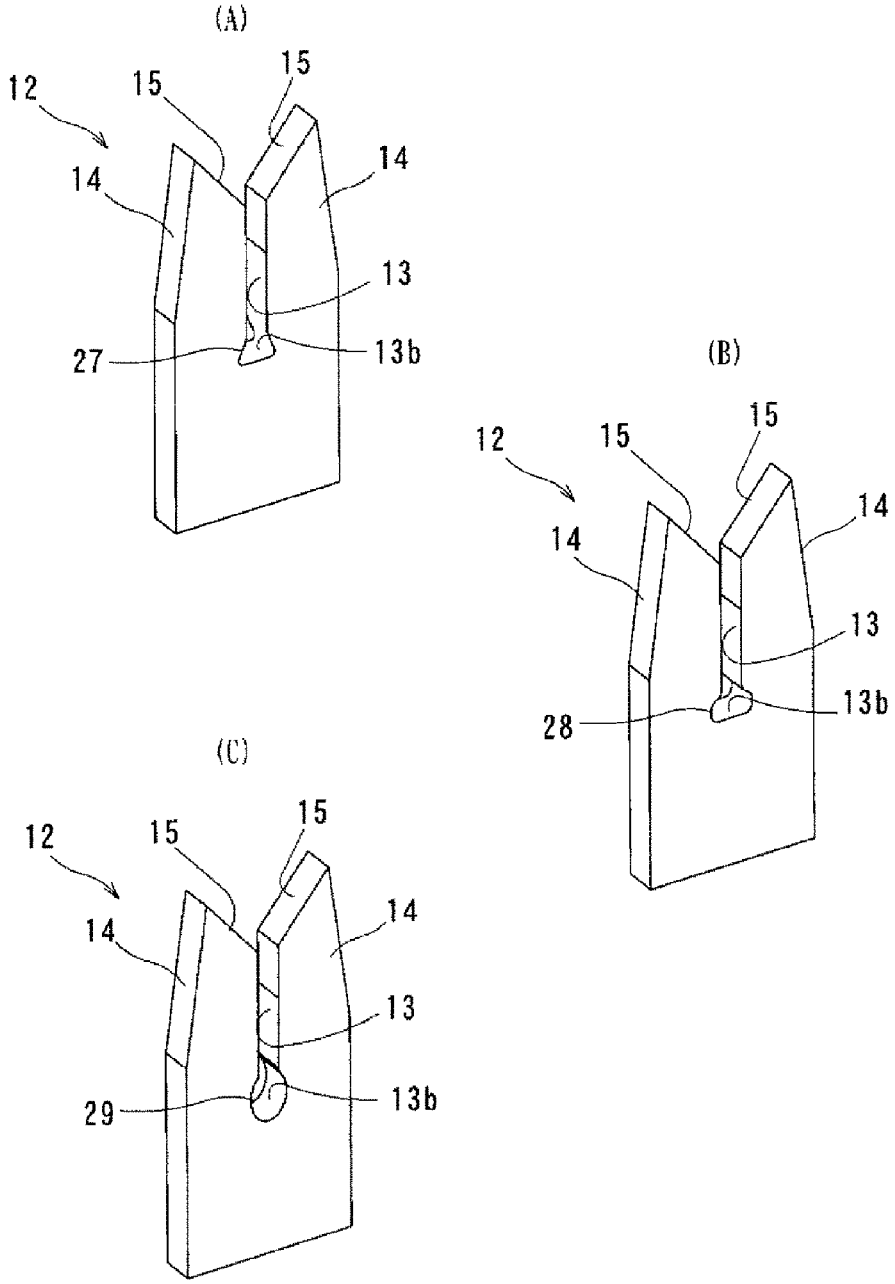
FIGS. 7(A) to 7(C) show a modified example of the terminal according to First Embodiment.
Figure 8:
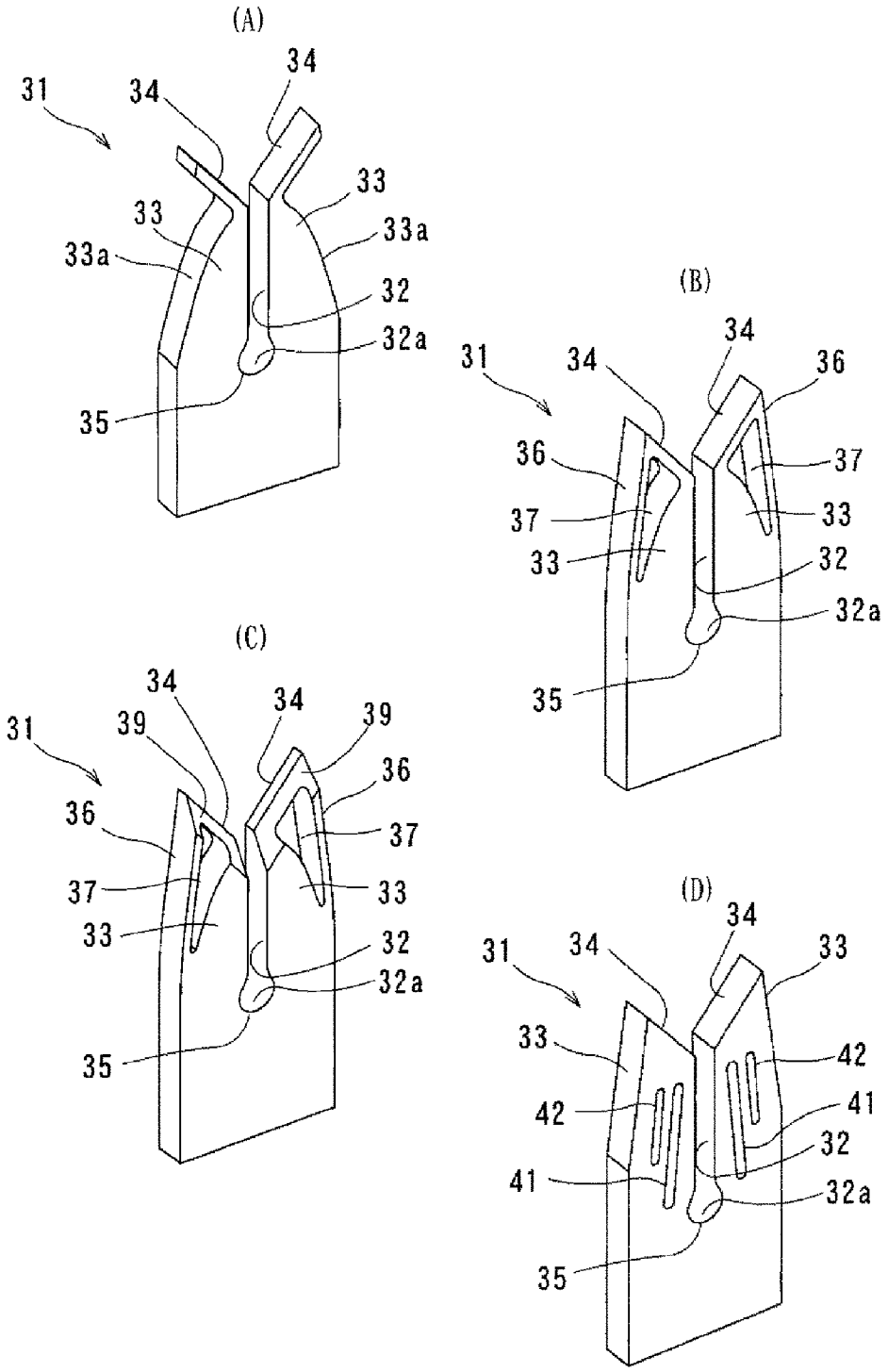
FIGS. 8(A) to 8(D) show a terminal according to Second Embodiment.
Figure 16:
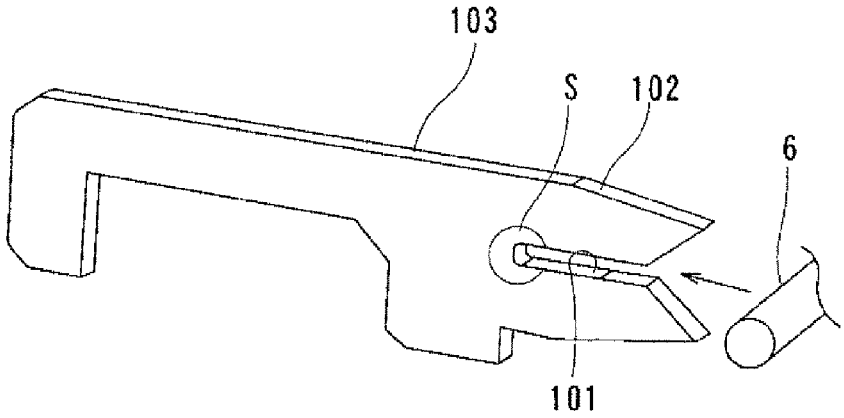
Fig. 16 Prior Art
FIG. 16(A) is a perspective view of a conventional terminal.
FIG. 16(B) is a graph showing the relation between a load applied to an insertion part of FIG. 16(A) and a displacement amount thereby.
Figure 16:
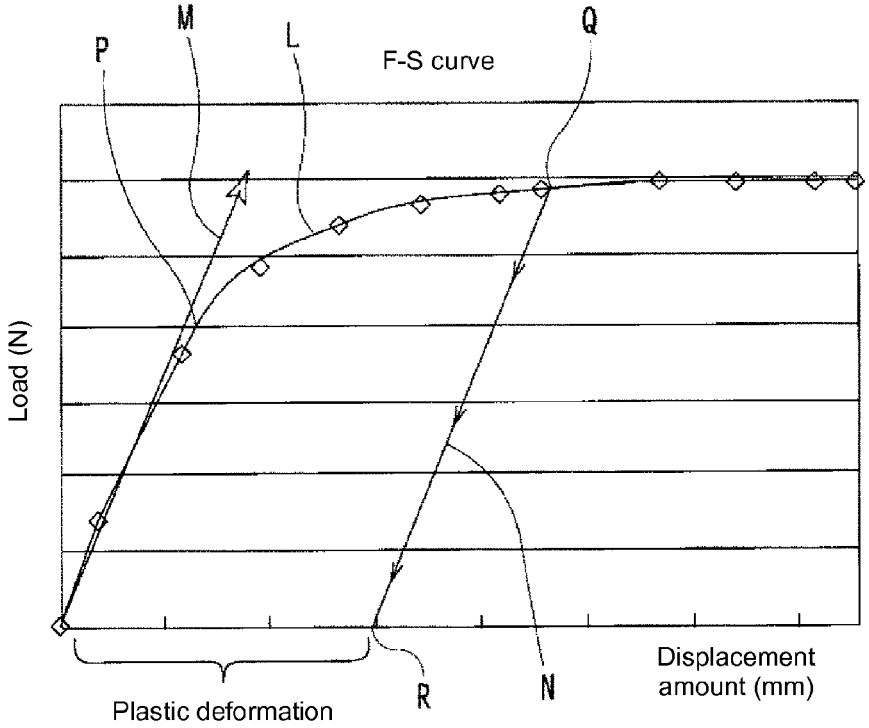
Fig. 16 Prior Art
Figure 17:
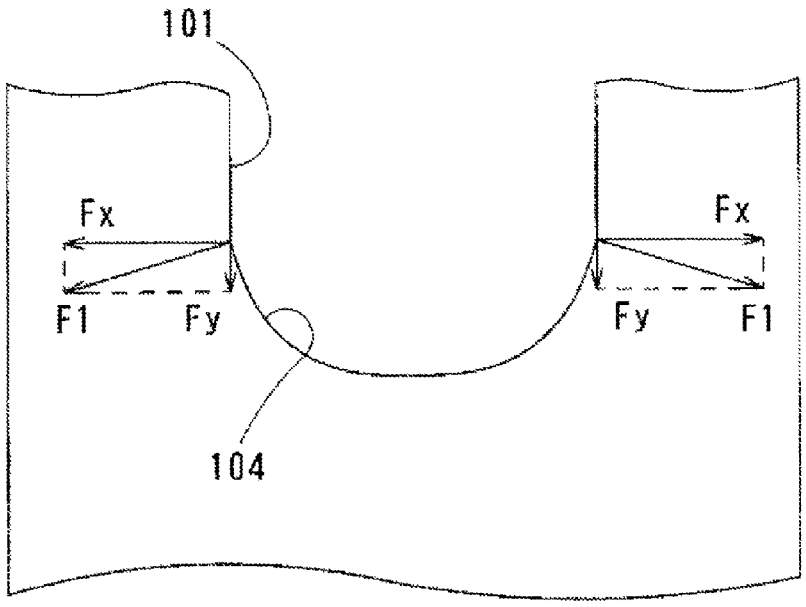
FIG. 17(A) is a partially enlarged view of a load applied to a conventional end.
FIG. 17(B) is a front view showing a load applied to a conventional insertion part.
Figure 17:
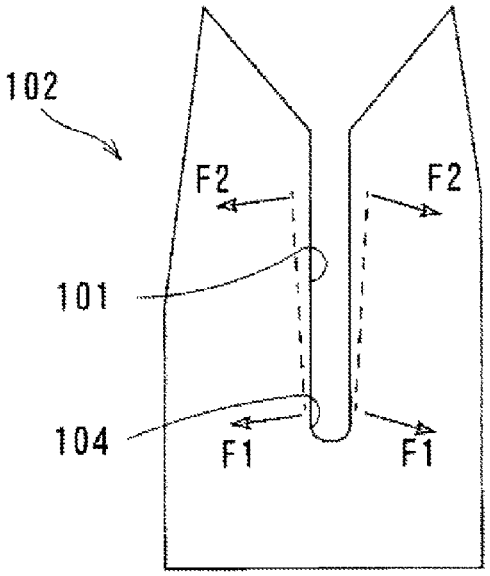

The present inventors conducted analysis of applying a load to each of the insertion part 12 according to the present invention and the conventional insertion part shown in FIG. 16(A). FIG. 4 shows analysis results. FIG. 4 is a graph showing the relation between each of loads, respectively applied to the insertion part 12 of the present invention and the conventional insertion part, and a displacement amount thereby.

According to the present analysis results, the inclination at the time of elastic deformation is small in the insertion part 12 of the present invention as compared with the conventional insertion part. Namely, it is found that the insertion part 12 of the present invention is apt to be elastically deformed and is not apt to be plastically deformed. Therefore, when the electrical wire 6 is pulled out in a state where the displacement of each insertion part has reached β, the insertion part 12 of the present invention gets back into the original shape along a straight line A. On the other hand, in the conventional insertion part, it gets back along a straight line B. Hence it was confirmed that the insertion part 12 of the present invention is apt to be elastically deformed, making it possible to reduce plastic distortion and ensure the repairability.

Further, it is found that, when the insertion part 12 of the present invention and the conventional insertion part are to be displaced in the same amount, the insertion part 12 of the present invention is displaced by a small load as compared with the conventional insertion part. It was thus found that the load for pressing the electrical wire 6 into the insertion groove 13 becomes small, and the electrical wire 6 becomes easy for pressing-in.

As shown in FIG. 5(A), the terminal 11 provided with the insertion part 12 according to First Embodiment has: a conductive part 18 formed with a step 17 at the center; the insertion part 12 which is fitted to one end of this conductive part 18 and erected in a vertical direction; and a plug part 19 which is formed at the other end of the conductive part 18 and fitted with an external contact.

It is to be noted that in the present embodiment, although the insertion part 12 as a separate body is fitted to the end of the conductive part 18, the insertion part 12 and the conductive part 18 may be provided in a unified manner (see FIG. 5(B)).

Further, as shown in FIGS. 6(A) and 6(B), a configuration may be formed where a linear notch 24 is provided at the bottom of the insertion part 12, and this notch 24 is engaged into a concave-shaped projection 25 formed on the upper surface of the conductive part 18, to connect the insertion part 12 to the conductive part 18.

The notched part of the present invention is not restricted to the shape of an arc.

For example, even when a triangular notched part 27 is formed at the end 13*b* of the insertion groove 13 as shown in FIG. 7(A) as a modified example of First Embodiment, a similar effect can be obtained. Further, a horizontally long, oblong hole-like notched part 28 may be formed as shown in FIG. 7(B), and a vertically long, oblong hole-like notched part 29 may be formed as shown in FIG. 7(C).

The insertion part of the present invention is not restricted to the above embodiment, and a variety of shapes can be adopted so long as a notched part is provided at the end of the insertion groove.

A second Embodiment is one in which an insertion part 31 is provided with an insertion groove 32, and a conductive arm part 33 with an outer edge 33*a* having the shape of a beam with uniform strength, as shown in FIG. 8(A). In this insertion part 31, a peeling part 34 extends from the upper end of the conductive arm part 33 so as to be open outward. Then, an arc-like notched part 35 is formed at an end 32*a* of the insertion groove 32. By adopting the above configuration, even when a load is applied at the time of pressing the electrical wire 6 into the insertion groove 32, stress concentration at the end 32*a* of the insertion groove 32 can be prevented and stress generated in the conductive arm part 33 is constant, thus making the conductive arm part 33 apt to be elastically deformed. This can reduce plastic deformation that occurs in the conductive arm part 33, to ensure the repairability.

Further, a modified example of the Second Embodiment is a case where a reinforcing part 36 is provided between the conductive arm part 33 having the shape of a beam with uniform strength and the end of the peeling part 34 in an insertion part 31, as shown in FIG. 8(B). In this insertion part 31, the outer edge of the conductive arm part 33, the peeling part 34 and the reinforcing part 36 form a substantially triangular through hole 37. This can improve supporting strength of the peeling part 34.

Further, as shown in FIG. 8(C), an inclined surface 39 inclined parallel to the upper edge of the conductive arm part 33 may be provided on the peeling part 34. Therefore, the coated layer 9 of the electrical wire 6 can be removed with ease and the electrical wire 6 can be pressed into the insertion groove 32 by a smaller load.

As shown in FIG. 8(D), a beam with uniform strength may be obtained by providing a long slit 41 on the insertion groove 32 side of the conductive arm part 33 and providing a short slit 42 on the outer side of this slit 41 along the outer shape of the conductive arm part 33.

It is to be noted that the number of slits is not restricted to two, but it may be plural being three or larger, and in this case, the beam with uniform strength can be obtained by providing the longest slit 41 in the vicinity of the insertion groove 32 and disposing the plurality of slits such that the lengths thereof sequentially become shorter as being more distant from the insertion groove 32.

Figure 9:
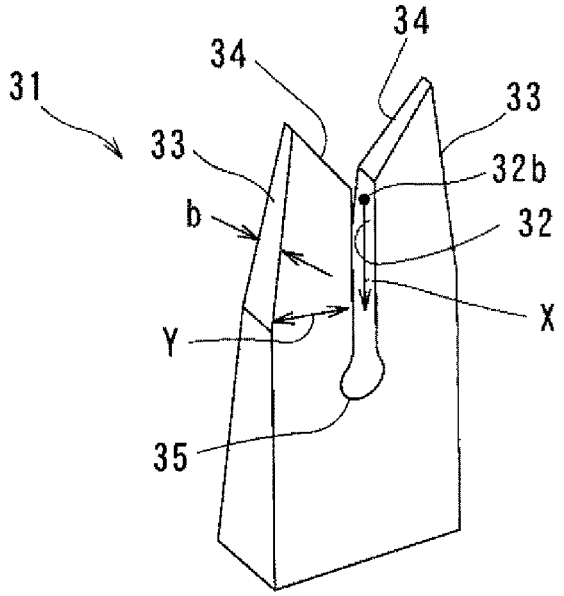
FIG. 9 shows a terminal according to Third Embodiment, and shows a perspective view showing a modified example where a thickness b of the conductive arm part is proportional to a distance X.
Figure 10:
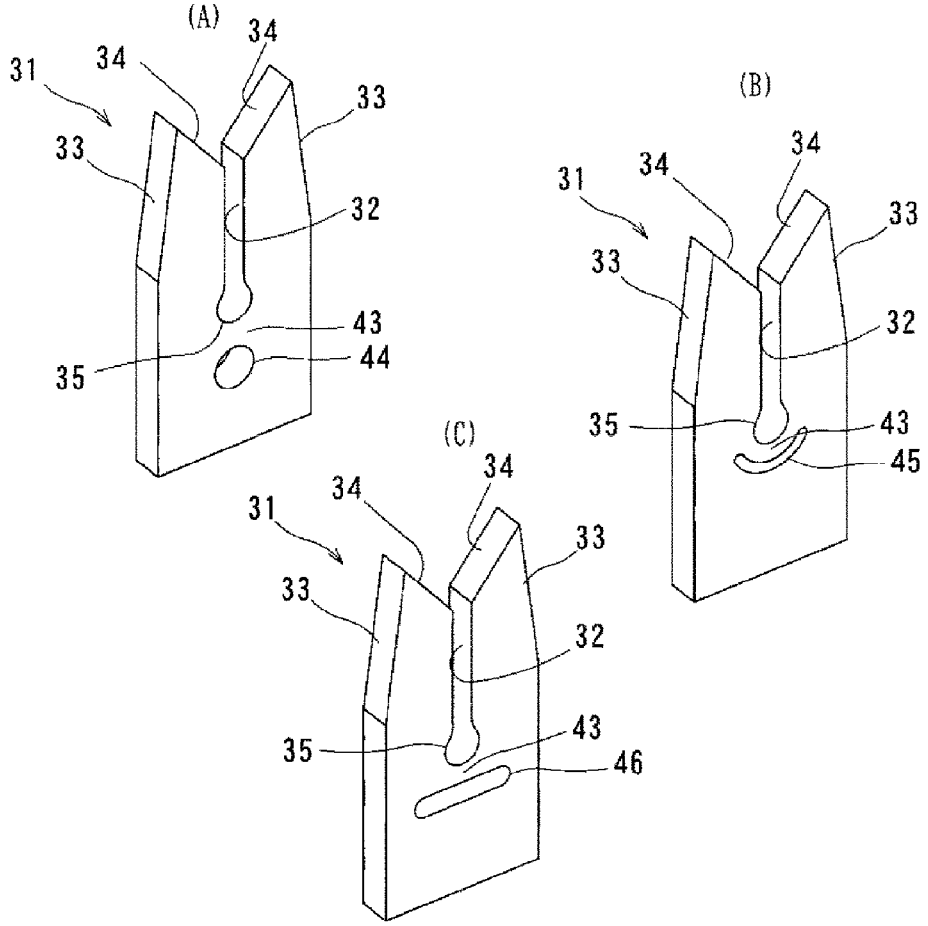
FIGS. 10(A) to 10(C) show a terminal according to Fourth Embodiment.
Figure 11:
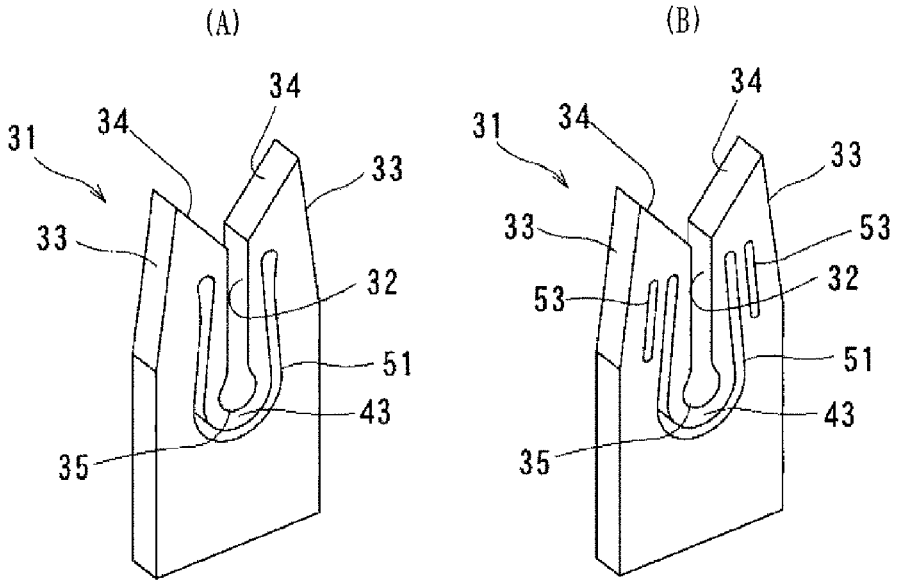
FIGS. 11(A) and 11(B) show a terminal according to Fifth Embodiment.

A Third Embodiment is a case where the conductive arm part 33 is formed to be the beam with uniform strength by making a substantially constant width Y and making a thickness b proportional to a distance X from the center 32*b* of a contact part between the conductive arm part 33 and the electrical wire 6 to the inside at the time of pressing-in of the electrical wire 6, as shown in FIG. 9.

A Fourth Embodiment is a case where a circular slit 44 is provided in a base 43 located near the arc-like notched part 35 as shown in FIG. 10(A);

As a modified example thereof, as shown in FIG. 10(B), an arc-like slit 45, which is curved downward and whose end is formed in a semicircular shape, may be provided.

Further, as another modified example, a linear slit 46 whose end is formed in a semicircular shape may be provided, as shown in FIG. 10(C). This prevents stress concentration on the base 43 of the insertion groove 32 at the time of application of a load and the conductive arm part 33 becomes apt to be elastically deformed, thereby to allow prevention of plastic deformation of the insertion part 31.

A Fifth Embodiment is a case where a U-shaped slit (first slit) 51, which extends along the insertion groove 32 and surrounds the arc-like notched part 35 of the insertion groove 32, is provided in the conductive arm part 33 of the insertion part 31, as shown in FIG. 11(A). This prevents stress concentration at the end 32*a* of the insertion groove 32 at the time of application of a load and the conductive arm part 33 becomes apt to be elastically deformed, thereby to prevent plastic deformation of the insertion part 31.

Similarly, as a modified example thereof, a linear slit (second slit) 53, whose end is formed in a semicircular shape, is provided on the outer side of the U-shaped slit 51 of the insertion part 31 along the outer shape of the conductive arm part 33, as shown in FIG. 11(B). This can more efficiently prevent plastic deformation.

Figure 12:
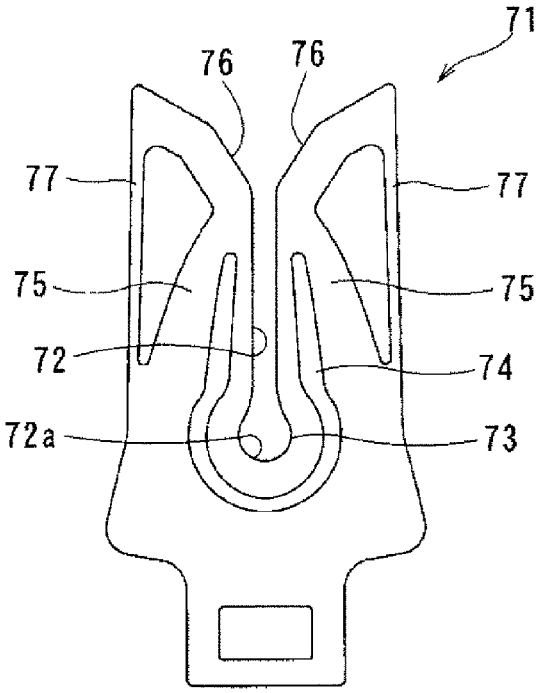
FIG. 12 is a front view showing a terminal according to Sixth Embodiment, and showing a modified example where an arc-like notch, a reinforcing part and a U-shaped slit are provided in the insertion part.
Figure 13:
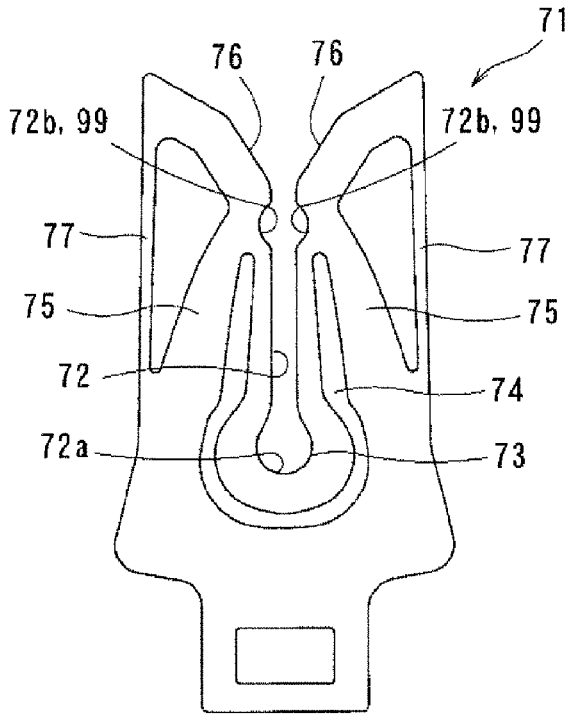
FIGS. 13(A) and 13(B) show a terminal according to Seventh Embodiment.
Figure 13:
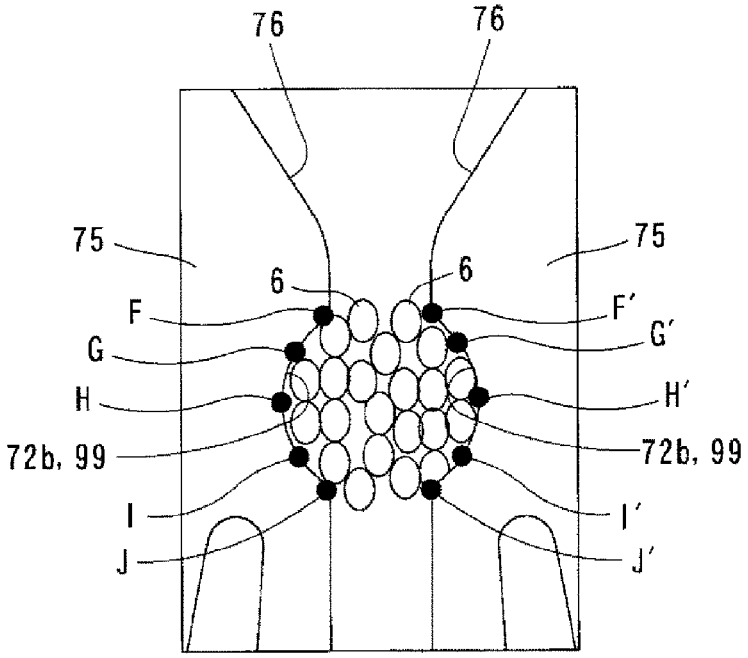

A Sixth Embodiment is a case where an insertion part 71 is provided with: an arc-like notched part 73 formed at an end 72*a* of an insertion groove 72; a U-shaped slit 74 surrounding this arc-like notched part 73 and extending along the insertion groove 72; and a reinforcing part 77 which is provided between a conductive arm part 75 and the end of a peeling part 76, as shown in FIG. 12. Hence the conductive arm part 75 can be regarded as two spring bodies (elastic bodies) separated by the slit 74, so as to further reduce plastic deformation.

Further, a pair of pressing-in notches 99 may be formed in positions (contact parts 72*b* with the conductor 6) opposed to the insertion groove 72, as in Seventh Embodiment shown in FIGS. 13(A) and 13(B). This pressing-in notch 99 has an arc shape curved outward. In addition, although the pair of pressing-in notches 99 has been formed in the present embodiment, this is not restrictive, and either one of the pressing-in notches 99 may be provided. Further, a shape of the pressing-in notch 99 is not particularly restricted, and may only be such a shape as to allow the conductor 6 to be pressed and fixed thereinto.

Figure 14:
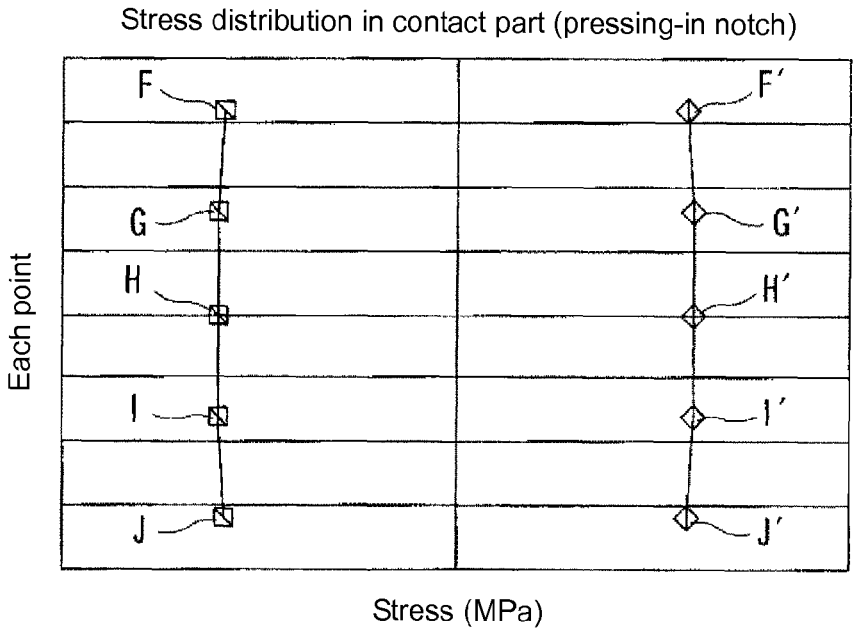
FIG. 14 is a graph showing reaction force from a conductor which is distributed to each point of the pressing-in notch.
Figure 15:
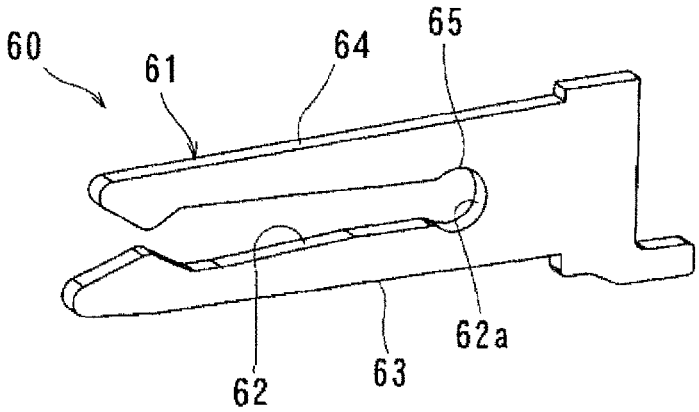
FIG. 15 shows a perspective view of Eighth Embodiment where the present invention is applied to a connector connection terminal for connecting a flexible print substrate.

The present inventors conducted analysis of reaction force from each of the conductors 6 distributed to points, F, F', G, G', H, H', I, I', J and J' of the pressing-in notch 99. FIG. 14 shows analysis results. It was found that reaction force from the conductor 6 is uniformly distributed to each of the above points, as shown in FIG. 14.

Although the insertion part 12 has been applied to the terminal 11 for use in the connector 1 to connect the electrical wire 6 in the above embodiment, this is not restrictive. For example, as in Eighth Embodiment shown in FIG. 15, the insertion part of the present invention may be applied to a connector connection terminal 60 for connecting a flexible print substrate.

This insertion part 61 is provided with: an insertion groove 62 to be inserted into by a flexible print substrate (not shown); a fixed piece 63 which extends below the insertion groove 62 and is fixed to a housing (not shown); and a conductive arm part 64 opposed to the fixed piece 63 with the insertion groove 62 provided therebetween. Since the arc-like notched part 65 is provided at an end 62*a* of the insertion groove 62 and the conductive arm part 64 has a shape approximate to that of the beam with uniform strength, it is possible to prevent stress concentration. Accordingly, plastic deformation is reduced, and at the time when the electrical wire is once pulled out of the insertion groove 62 and reinserted thereinto to be used, the holding force does not decrease, and the repairability can be ensured.

As discussed herein, the present invention provides a terminal in which an insertion groove to be pressed into by a conductor is provided between a pair of conductive arm parts, wherein a notched part larger than a width of the insertion groove is provided at the end of the insertion groove.

With the above configuration, a load applied to the notched part and a load applied to an opening of the insertion groove cancel each other, thereby to facilitate elastic deformation, allowing prevention of stress concentration at the end of the insertion groove and reduction in plastic deformation that occurs in the conductive arm part. Accordingly, even when the electrical wire is once pulled out of the insertion groove and reinserted thereinto, the holding force does not decrease, and the repairability can be ensured. Further, since the repairability can be ensured just by providing the notched part, the configuration of the conductive arm part is simplified and production cost of the terminal can be reduced. Moreover, the conductive arm part becomes apt to be elastically deformed, thereby facilitating pressing-in of the conductor.

The notched part may be an arc-like notch with an angle over 180°.

Further, a slit may be provided in a base located on the deeper side than the end of the insertion groove.

This prevents stress concentration on the base of the insertion groove at the time of application of a load and the conductive arm part becomes apt to be elastically deformed, thereby to prevent plastic deformation of the insertion part.

A first slit extending along the insertion groove and surrounding the end of the insertion groove may be provided in the conductive arm part.

This prevents stress concentration at the end of the insertion groove at the time of application of a load and the conductive arm part becomes apt to be elastically deformed, thereby to prevent plastic deformation of the insertion part.

A second slit may be provided between the outer edge of the conductive arm part and the first slit.

This can more reliably prevent plastic deformation of the conductive arm part.

A peeling part for removing a coated material of the conductor may be provided at the end surface of the conductive arm part.

This can make a connection operation for the conductor efficiently performed on the terminal.

A width from the outer edge of the conductive arm part to the insertion groove may become larger from the center of a contact part between the conductive arm part and the conductor toward the end at the time of pressing-in of the conductor.

This can more reliably prevent stress concentration at the end of the insertion groove.

Further, stress generated in the conductive arm part is constant even when a load is applied at the time of pressing the conductor into the insertion groove, thereby preventing concentration of stress on a specific place of the conductive arm part. This can reduce plastic deformation that occurs in the conductive arm part, to improve the repairability.

The outer edge of the conductive arm part may have a curved shape outwardly projecting from the end of the insertion groove toward the center of the contact part.

A reinforcing part may be bridged between the conductive arm part and the end of the peeling part configured to remove a coated material of the conductor.

Providing the reinforcing part improves supporting strength of the peeling part as well as allowing removal of the coated material.

The conductive arm part may be provided with a plurality of slits such that the slit provided in a position closest to the insertion groove has the maximal length and the slits sequentially have smaller lengths as being more distant from the insertion groove.

With the above configuration, even when the conductor is pressed into the insertion groove, stress generated in the conductive arm part is constant, and hence the stress is not biased to a specific place of the conductive arm part, to allow prevention of stress concentration at the end. Hence it is possible to reduce plastic deformation that occurs in the conductive arm part, so as to ensure the repairability at the time when the conductor is once pulled out of the insertion groove and reinserted thereinto to be used.

when Y represents a width from the outer edge of the conductive arm part at a point of a distance X from the center of a contact part between the conductive arm part and the conductor toward the inside at the time of pressing-in of the conductor and b represents a thickness of the conductive arm part, the width Y may be substantially constant and the thickness b may be proportional to the distance X.

With the above configuration, even when the conductor is pressed into the insertion groove, stress generated in the conductive arm part is constant, and hence the stress is not biased to a specific place of the conductive arm part, to allow prevention of stress concentration at the end. Hence it is possible to reduce plastic deformation that occurs in the conductive arm part, so as to ensure the repairability at the time when the conductor is once pulled out of an insertion groove and reinserted thereinto to be used.

A pressing-in notch to be pressed and fixed into by the conductor may be formed on at least one side of the insertion groove.

Therefore, reaction force by the pressed/fixed conductor is uniformly distributed to the pressing-in notch.

A pair of pressing-in notches to be pressed and fixed into by the conductor may be formed in opposed positions of the insertion groove.

Therefore, reaction force by the pressed/fixed conductor is uniformly distributed to the pressing-in notch.

The pressing-in notch may be an arc curved outward.

Therefore, reaction force by the conductor is uniformly distributed to the pressing-in notch in a more reliable manner.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A terminal, comprising:

an insertion groove to be pressed into by a conductor disposed between a pair of conductive arm parts, the insertion groove having side faces located opposite each other;

wherein a notched part larger than a width of the insertion groove is disposed at an end of the insertion groove;

a pressing-in notch positioned on each side face of the insertion groove wherein the the conductor presses-in and fixes the pressing-in notches; and wherein a first slit extending along the insertion groove and surrounding the end of the insertion groove is disposed in the conductive arm part.

2. The terminal according to claim 1, wherein a second slit is disposed between an outer edge of the conductive arm part and the first slit.

3. A terminal, comprising:

an insertion groove to be pressed into by a conductor disposed between a pair of conductive arm parts, the insertion groove having side faces located opposite each other;

wherein a notched part larger than a width of the insertion groove is disposed at an end of the insertion groove;

a pressing-in notch positioned on each side face of the insertion groove wherein the the conductor presses-in and fixes the pressing-in notches; and wherein the conductive arm part comprises a plurality of slits such that a first slit is disposed in a position closest to the insertion groove has a maximal length amongst the plurality of slits and the plurality of slits sequentially have smaller lengths as they are positioned further away from the insertion groove.

4. The terminal according to claim 3, wherein a peeling part for removing a coated material of the conductor is disposed at an end surface of the first conductive arm part.

5. A terminal, comprising:

an insertion groove to be pressed into by a conductor disposed between a pair of conductive arm parts, the insertion groove having side faces located opposite each other;

wherein a notched part larger than a width of the insertion groove is disposed at an end of the insertion groove;

a pressing-in notch positioned on each side face of the insertion groove wherein the the conductor presses-in and fixes the pressing-in notches;

wherein the notched part is an arc-like notch with an angle over 180°; and wherein a first slit extending along the insertion groove and surrounding the end of the insertion groove is disposed in a first conductive arm part.

* * * * *